United States Patent [19]

Pitts

[11] Patent Number: 4,491,894

[45] **Date of Patent: * Jan. 1, 1985**

[54] ANTISTATIC FLOORMATS

[75] Inventor: Warren R. Pitts, Needham, Mass.

[73] Assignee: Dennison Manufacturing Company, Framingham, Mass.

[ * ] Notice: The portion of the term of this patent subsequent to Nov. 15, 2000 has been disclaimed.

[21] Appl. No.: 517,620

[22] Filed: Jul. 27, 1983

Related U.S. Application Data

[63] Continuation-in-part of Ser. No. 346,716, Feb. 8, 1982, Pat. No. 4,415,946.

[51] Int. Cl.[3] ..... H05F 3/00

[52] U.S. Cl. ..... 361/212; 361/216

[58] Field of Search ..... 361/212, 216, 220; 428/924, 927, 929, 931

[56] References Cited

U.S. PATENT DOCUMENTS

| | | | |
|---|---|---|---|
| 2,325,414 | 7/1943 | McChesney et al. | 361/216 X |
| 2,416,202 | 2/1947 | Naumann | 361/212 |
| 4,208,696 | 6/1980 | Lindsay et al. | 361/212 |
| 4,301,040 | 11/1981 | Berbeco | 361/212 X |
| 4,363,071 | 12/1982 | Rzepecki et al. | 361/220 |
| 4,415,946 | 11/1983 | Pitts | 361/212 |

*Primary Examiner*—Harry E. Moose, Jr.

*Attorney, Agent, or Firm*—George E. Kersey; Barry D. Josephs

[57] ABSTRACT

Antistatic floormats having superior mechanical properties and charge dissipating characteristics. The floormats consist of flexible laminations of a semiconductive material, which resist fracture due to local stresses. The laminations include one or more conductive edge clips or other ion collectors in order to provide efficient charge dissipation paths. A preferred design includes a base construction configured to provide structural support with reduced stress concentrations. An alternative base construction incorporates an array of edge supports with an unbroken central area. The floormats are generally characterized by a transparent or translucent appearance, optionally overlaid with a decorative pattern of semiconductive resin having anti-skid characteristics.

17 Claims, 5 Drawing Figures

ANTISTATIC FLOORMATS

BACKGROUND OF THE INVENTION

This instant application is a continuation-in-part of U.S. patent application Ser. No. 346,716, filed Feb. 8, 1982, now U.S. Pat. No. 4,415,946.

The present invention relates to floormats having antistatic properties, and most especially to antistatic floormats of a transparent appearance.

One well known problem in office environments is the risk of shock to office workers due to electrical charge build up. This is especially prevalent in offices with large electronic machinery and the like. It is known to provide floormats having a grounding connection to allow charge dissipation. Such floormats typically consist of a plastic material in which carbon black particles or other electrically conductive material is dispersed, resulting in a semiconductive composite. These prior art designs, however, may have an unattractive appearance due to the dispersed opaque material.

Another commonly encountered phenomenon in prior art floormats is an unsatisfactory charge dissipation rate. Such mats commonly incorporate one or more dielectric or semiconductive panels and rely on through-conduction and limited surface conduction to dissipate charge. Although these prior art floormats sometimes include antistatic agents for enhanced surface conduction and charge dissipation, these designs are ineffectual at low relative humidities. It is also known to include conductive layers in such structures, as shown in U.S. Pat. No. 4,301,040 to Berbecco. Such floormats still suffer limited charge dissipation rates due to the minimal conduction through an essentially dielectric top layer.

A further flaw sometimes encountered in prior art floormats, which are typically molded or extruded thermoplastic structures, is their tendency toward fracture due to localized stresses. This problem is particularly prevalent in mats which include protruding base support members.

Accordingly it is a primary object of the invention to design floormats which combine antistatic characteristics with a pleasing appearance. A particular object of the invention is to provide antistatic floormats of generally transparent appearance.

Another object of the invention is to achieve rapid discharge rates in such antistatic floormats. As a related object, it is desirable to maintain this characteristic under varying relative humidities.

A further object of the invention is the design of floormats having superior mechanical characteristics, particularly fracture resistance.

SUMMARY OF THE INVENTION

In fulfilling the above and additional objects, the invention provides antistatic floormats having superior mechanical characteristics, charge dissipation rates, and aesthetically pleasing appearance. The floormats include a plurality of semiconductive layers, laminated to reduce stress in the composite. In the preferred embodiment, each of these layers is comprised of a transparent, semiconductive material. The floormats include one or more conductive ion collectors, preferably in the form of edge clips, to provide efficient charge dissipation paths. In the preferred embodiment, the floormats are fabricated of a transparent material, and include an overlaid conductive or semiconductive patterned layer on one or both of the top and bottom faces.

In accordance with one aspect of the invention, the floormats are characterized by superior charge dissipation properties due to the existence of efficient conductive paths from the upper surface to ground. The chairmats of the preferred embodiment rely on enhanced surface conduction over the top and bottom faces. These paths advantageously include a large series resistance to prevent electrical shock. The use of conductive edge clips markedly increases the charge dissipation provided by the through-conduction of the semiconductive panels.

Alternative or additional ion collectors may take the form of members passing through the floormat body, such as conductive screws. Electrical continuity between such ion collector structures and any conductive pattern layers assures rapid, efficient charge dissipation.

In another aspect of the invention, the semiconductive layers are preferably each comprised of an antistatic agent admixed with a clear thermoplastic polymer. This composition advantageously includes a plasticizer to provide flexibility and resistance to fracture. In the preferred embodiment, this material comprises polyvinylchloride as a binder for a dispersed antistatic agent. Alternative binder formulations include, for example, polypropylene, polycarbonates, and acrylics.

A further aspect of the invention concerns the structural design of the floormat base. For mats to be placed on rugs or other yielding surfaces, the base may include protruding members to firmly anchor the mat. These base members preferably are bunched along the lateral edges of the mats to properly distribute the loads exerted by chairmat casters. Alternatively, the mat may accommodate a variety of floor surfaces by including a projecting lattice at its base, which provides a support structure with reduced stress concentrations. A particular, preferred geometry for such lattice includes a plurality of stress-relief cavities at lattice cross-points. Such mats may further include disks inserted within these cavities, for anti-skid characteristics.

Yet another aspect of the invention relates to an aesthetically pleasing appearance in such floormats, which is partially attributable to their generally transparent appearance. It has been found advantageous in this regard to include a decorative pattern at either the upper or lower floormat surface (or both). Such pattern may consist of an imprinted semiconductive resin, which may contain a dispersion of carbon black or a like conductive medium. At low relative humidities these layers effectively supplement the surface conductivity of such floormats at the top and bottom faces. Advantageously, these surface layers have a relatively high coefficient of friction.

BRIEF DESCRIPTION OF THE DRAWINGS

The above and additional aspects are illustrated in the following detailed description of the preferred embodiments, which is to be taken with the drawings, in which.

DETAILED DESCRIPTION

Figure 1:
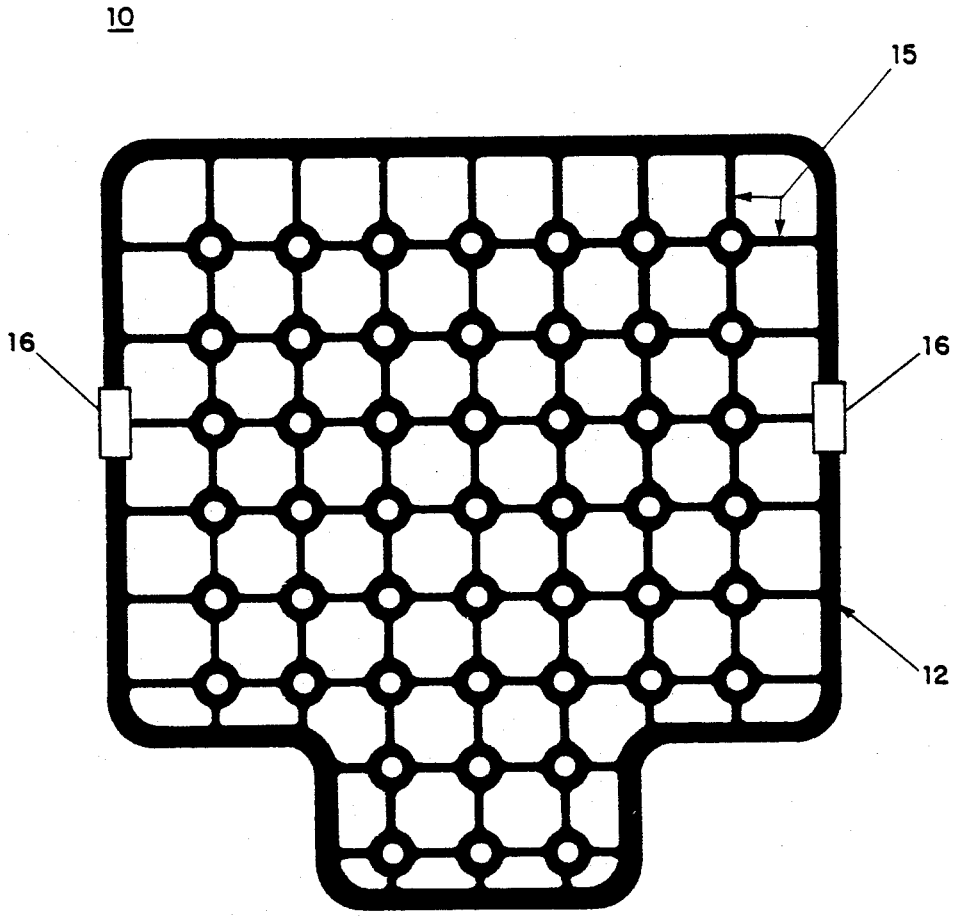
FIG. 1 is a plan view of an antistatic floormat in accordance with the preferred embodiment.

Reference should now be had to FIGS. 1–5 for a detailed description of antistatic floormats in various preferred embodiments. As seen in FIG. 1, an antistatic floormat 10 includes a transparent body 12 of desired configuration, overlaid with a pattern of semiconductive resin 15. Floormat 10 includes one or more conductive clips 16 at the edge, electrically connected with the semiconductive pattern 15, with a corresponding pattern 17 at the lower face (FIG. 3), as well as with floormat body 12. This arrangement has been found to provide superior charge dissipation characteristics due to surface and volume conduction. As further described below, a grounding connection for each of the edge clips 16 allows rapid discharge without risk of electrical shock to the user. The transparent floormat body 12 with overlaid pattern 15 provides an aesthetically pleasing effect together with the utilitarian advantages discussed below.

In the perspective view of FIG. 2, in which the floormat 10 of FIG. 1 is seen from below, this mat is seen to include a novel support structure at its base. Floormat 10 incorporates a protruding lattice 13-r, which is configured in an array of circular cavities 19 at lattice crossover points. Lattice 13-r provides structural support for floormat 10, whether placed on a hard floor or a more yielding surface such as a rug. To resist skidding on smooth floors, the mat may further be provided with a plurality of frictional disks 18, inserted in cavities 19. In addition, the lattice 13-r may be overprinted with a semiconductive resin 17 (FIG. 3), such as a formulation containing carbon black, providing enhanced surface conductivity at various humidity conditions, and exhibiting a high coefficient of friction. This configuration avoids the tendency toward fracture which is common in floormats having an angular surface geometry. This may be attributed to the even loading which is characteristic of the illustrated architecture.

Figure 2:
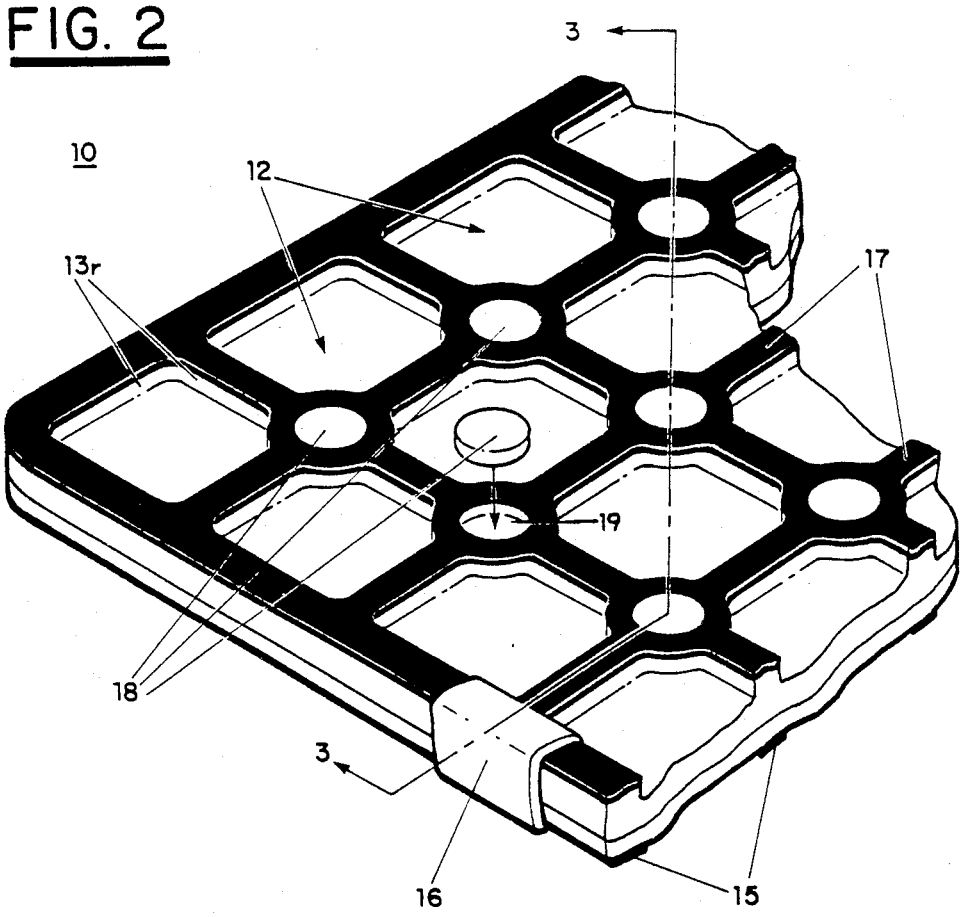
FIG. 2 is a partial perspective view of the floormat of FIG. 1, seen from below.
Figure 3:
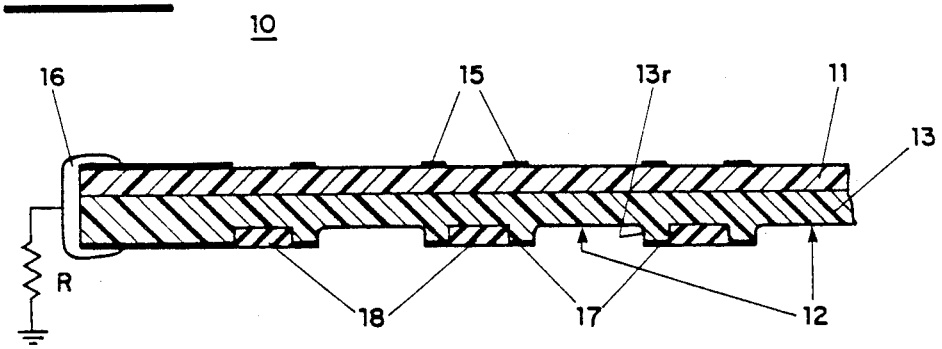
FIG. 3 is a sectional schematic view of the floormat of FIG. 2, taken through the section 3—3.

Referring to the sectional view of FIG. 3, showing a section taken through lines 3—3 in FIG. 2, this mat is comprised of a lamination of semiconductive layers 11 and 13. The lamination of two or more layers to form the composite floormat structure reduces the tendency toward cracking and other mechanical degradation, due to a varied orientation of the long chain polymers. In the preferred embodiment, these layers are comprised of a transparent or translucent material, optionally overprinted with a semiconductive resin in layers 15 and 17, as discussed above. The inserted disks 18 may consist of a variety of plastic foams, elastomers, or other materials, and optionally are bonded within cavities 19 using pressure sensitive adhesive. Edge clip 16 is in electrical communication with resin layers 15 and 17, as well as with layers 11 and 13, providing a grounding path through a high order resistor R (illustratively on the order of megohms).

The charge dissipation of the antistatic floormats of the invention as well as of the prior art, is attributable both to conduction through the floormat bodies, as well as surface conduction along the top and bottom faces and the edges of the floormats. Generally, however, the former effect is minimal, inasmuch as the polymers typically employed in floormat construction are essentially electrical insulators, with a volume resistivity on the order of $10^{12}$ ohm-centimeters or more. Therefore most of the discharge occurs via surface conduction, as well as by ion exchange with ambient moisture, and the charge dissipation performance of such floormats may largely be analyzed in terms of the surface resistivity of the various areas (especially that contacted by the user). Surface resistivities on the order of $10^{12}$–$10^{13}$ ohms per square generally give poor antistatic chairmat protection; $10^{11}$–$10^{12}$ ohms per square are considered moderate values; and $10^{10}$ ohms per square and below may be considered excellent surface resistivities for antistatic protection.

In the floormats of the invention the surface conduction occurs in part due to the inclusion of antistatic agents in the polymeric materials of the various layers, as discussed below. This conduction, however, is humidity dependent and tends to be quite limited at low relative humidities. The invention therefore provides additional conductive paths such as the semiconductive resin layers 15 and 17 and the conductive clips 16 (FIG. 3). These structures provide excellent charge dissipation characteristics over varying environmental conditions.

Preferred compositions for layers 11, 13 of antistatic floormat 10 incorporate a transparent or translucent polymer system, including an antistatic agent, plasticizer, and other additives as discussed below. The most preferred resin binder is polyvinylchloride; a variety of other suitable transparent thermoplastic materials are known in the art, such as polypropylene, polycarbonates, and acrylic polymers. These formulations generally include an antistatic agent, i.e., an additive which provides enhanced surface conductivity in the compound materials. Although it is possible to utilize a surface treatment for this purpose, it is more desirable to incorporate an additive in bulk for more permanent antistatic protection; this additive is generally observed to form a surface film in the plastic mixture. The antistatic agent is preferably characterized by a partial incompatibility with the binder resin for this purpose, and desirably is hydrophilic in order that adsorbed atmospheric moisture will form an electrically conductive surface film. These adsorbed moisture layers dissipate built up electrostatic charge. As such, this effect is highly humidity dependent, i.e. less efficacious at low relative humidities. A variety of chemicals are known for this purpose including polyglycols and their derivatives, sulphonic acids and sulphonates, polyhydric acids and their derivatives, and certain long chain amines, amides, and quaternary bases. These materials, particularly the aliphatic and glycerol-based esters, typically act as internal and external lubricants.

Other suitable additives include plasticizers, to provide the requisite flexibility; heat stabilizers; lubricants; and additives for superior transparency. The formulation may be varied over the various layers. It has been found advantageous, for example, to include more plasticizer in the top layer 11 than in the bottom layer 13, thereby providing the requisite flexibility and fracture resistance, along with adequate structural support and reduced permanent deformation.

Figure 4:
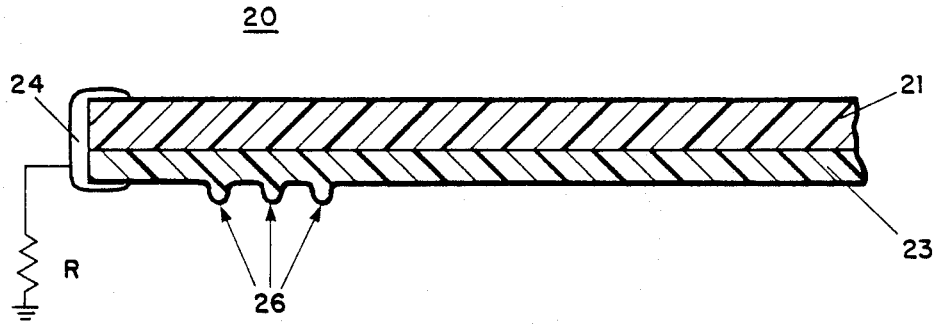
FIG. 4 is a sectional schematic view of an alternative antistatic floormat design.

FIG. 4 gives a sectional schematic view of an alternative floormat construction 20. The base layer 23 includes integrally molded studs 26 which anchor the mat 20 on relatively yielding surfaces such as rugs. Most preferably these studs 26 are bunched along the lateral edges of floormat 20 for a more uniform stress distribution for use as a chairmat.

Figure 5:
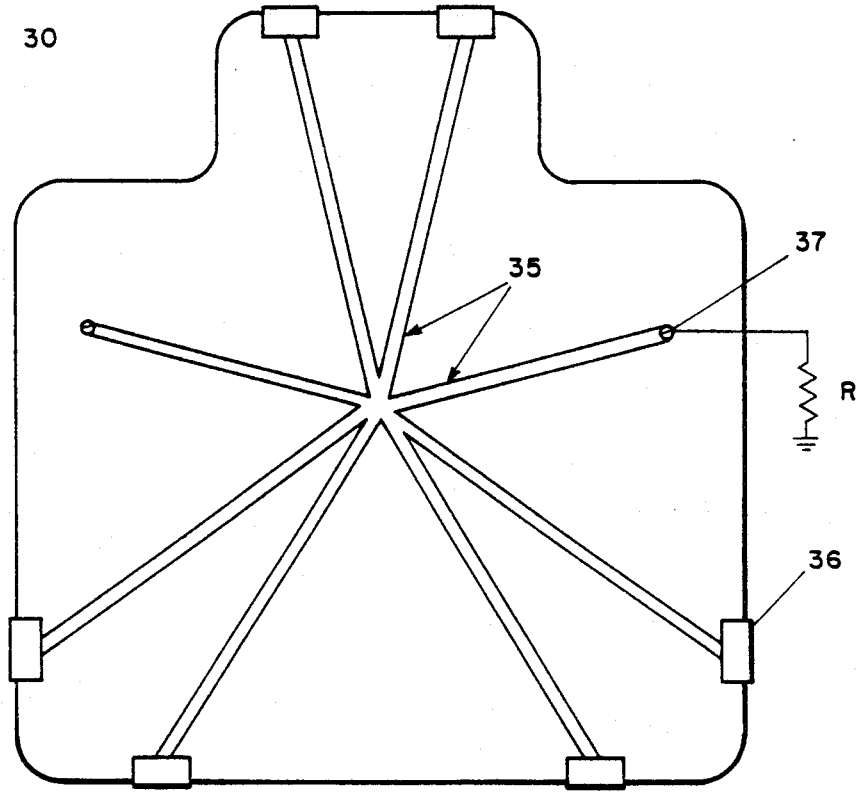
FIG. 5 is a plan view of a further antistatic floormat construction.

FIG. 5 shows a further floormat design 30 in a top plan view. Floormat 30 includes a matrix of conductive wires 35 to provide interconnections to ground. Grounding is achieved both using conductive edge clips 36 and inserted conductive screws 37 as ion collectors.

The invention is further illustrated by reference to the following nonlimiting examples, in which all parts are by weight unless otherwise noted.

EXAMPLE I

An antistatic floormat of the type illustrated in FIGS. 1–3 was constructed using the formulations given in Table I for the semiconductive layers 11, 13. These layers were formed separately by a continuous molding process, wherein the molten thermoplastic formulation was extruded into circumferential cavities of a rotating molding wheel. These layers were laminated together during the second extrusion.

Resin layers 15 and 17 were formulated using the composition set forth in Table II. These semiconductive black layers were screen printed in the pattern illustrated in FIGS. 1 and 2 on the top and bottom surfaces of the chairmat. Thicknesses of the various layers were: layer 11, 0.02 inch; layer 13, 0.125 inch; layers 15 and 17, 0.004 inch. Lattice 13-r had a depth of 0.06 inch. Polystyrene foam disks 18 were bonded within circular cavities 19 using pressure sensitive adhesive. A series of stainless steel edge clips 16 were press-fitted as shown in FIGS. 2, 3, grounding the floormat 10 through 1 megohm resistors.

The following tests were preformed in a humidity-controlled chamber, at 20% R.H., 22° F. Potential readings were taken using a Model 144-S-4 voltmeter and 1017E probe of Monroe Electronics, Middleport, N.Y.

A subject wearing synthetic soled shoes was triboelectrically charged to a reference voltage of around 12 KV. The subject was discharged through the floormat to around 0.8 KV in one second. This floormat exhibited comparable, excellent characteristics over a variety of relative humidities. For reference purposes, these readings were repeated for a prior art floormat consisting of a laminate of polyvinyl chloride layers in which only the bottom layers included antistatic agent. The prior art floormat discharged the subject to about 2.5 KV in 15 seconds.

Surface resistivity measurements for the floormat of Example I were approximately $1.0\times10^{10}$ ohms/sq. for the upper surface 11, $1.3\times10^{10}$ ohms/sq. for the lower surface 13, and $4.0\times10^{7}$ ohms/sq. for the printed grids 15, 17. The prior art chairmat exhibited surface resistivities of $1.0\times10^{12}$ ohms/sq. for the upper surface, and $3.3\times10^{15}$ ohms/sq. for the lower surface.

EXAMPLE II

The antistatic chairmat of Example I was modified to incorporate on its lower face an ion collector system of the type illustrated in FIG. 5. The floormat 20 included an array of copper wires 35 linked to the ion collectors 37 and stainless steel clips 36. Ion collectors 37 consisted of semiconductive screws including a carbon black dispersant. A semiconductive grid 15 was printed only on the upper face. Using the test conditions of Example I, the subject was observed to discharge to about 0.6 KV in one second.

TABLE I

| Function | Name | Parts by Weight |
|---|---|---|
| Binder | Geon 30 polyvinyl chloride[1] | 100 |
| Plasticizer | Dioctyl phthalate (DOP) | 30[2] or 20[3] |
| Antistatic Agent | Hostastat HS-1[4] | 1.5 |
| Heat Stabilizer | MK 2018[5] (liquid barium/cadmium/zinc organic complex) | 2.5 |
| Optical Clarity | Stearic Acid | 0.7 |
| Lubricant | Drapex 6.8[5] (epoxidized soybean oil) | 2.5 |

[1]Geon 30 is a tradename of the B.F. Goodrich Chemical Co., Cleveland, OH.
[2]In top layer 11.
[3]In bottom layer 13.
[4]Hostastat HS-1 is a tradename of the American Hoechst Corp. Somerville, N.J.
[5]WITCO-Argus Chemical Co., New York, NY.

TABLE II

| Name | Parts by Weight |
|---|---|
| Elvacite 2044 acrylic resin[1] | 36 |
| Nitrocellulose (30 percent ethyl acetate)[2] | 8 |
| Carbon Black (Regal 400R)[3] | 8 |
| Solvent: | |
| Toluene | 75 |
| Ethyl Acetate | 75 |

[1]Elvacite 2044 is a tradename of E.I. Dupont de Nemours & Co., Wilmington, Del.
[2]Hercules Inc., Wilmington, Del.
[3]Regal 400R is a tradename of Cabot Corp., Boston Mass.

While various aspects of the invention have been set forth in the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims. The antistatic mats disclosed herein may be employed in a variety of applications, such as chairmats, floormats, wall coverings, and other uses.

I claim:

1. A charge dissipating mat, comprising:

a plurality of transparent thermoplastic layers, each layer containing an antistatic agent, forming a lamination with first and second faces;

at least one electrically conductive ion collector member; and an electrically conductive medium on at least one of the first and second faces of said mat, connected with said ion collector member.

2. A charge dissipating mat as defined in claim 1, wherein said ion collector member comprises an edge clip bridging the upper and lower faces of said mat.

3. A charge dissipating mat as defined in claim 1, wherein the thermoplastic layers include a binder material selected from the group polyvinyl chloride, polypropylene, polycarbonates, and acrylic polymers.

4. A charge dissipating mat as defined in claim 3 wherein the transparent thermoplastic layers are further comprised of a plasticizer.

5. A charge dissipating mat as defined in claim 1 wherein the ion collector member is electrically grounded through a current limiting resistor.

6. A charge dissipating mat as defined in claim 1 wherein the second face of said mat is configured with a plurality of support members, characterized by smooth surface curvature.

7. A charge dissipating mat as defined in claim 1 wherein said conductive medium comprises a printed semiconductive pattern.

8. A charge dissipating mat as defined in claim 7 wherein the semiconductive pattern is comprised of a thin layer of thermoplastic resin containing dispersed carbon black powder.

9. A charge dissipating mat as defined in claim 1 wherein the conductive medium comprises a matrix of elongate metallic members.

10. A charge dissipating mat, comprising a plurality of transparent thermoplastic layers, forming a lamination with first and second faces; and an opaque pattern layer laminated to at least one of said first and second faces.

11. A charge dissipating mat as defined in claim 10 wherein the opaque pattern layer is comprised of an electrically conductive or semiconductive material.

12. A charge dissipating mat as defined in claim 11 further comprising an electrically conductive member connected with said opaque pattern layer.

13. A charge-dissipating mat, comprising a plurality of transparent thermoplastic layers, forming a lamination with first and second faces; and first and second opaque pattern layers respectively laminated to said first and second faces, in symmetric registration.

14. A charge-dissipating mat as defined in claim 13, wherein the opaque pattern layers are characterized by a relatively high coefficient of friction.

15. A charge dissipating mat as defined in claim 10 wherein the opaque pattern layer is comprised of a thermoplastic binder resin with dispersed carbon black powder.

16. A charge-dissipating mat, comprising a plurality of transparent thermoplastic layers, forming a lamination with first and second faces, wherein said first face is configured in a protruding lattice structure with recessed interstices; and an opaque pattern layer in registration with and laminated to said protruding lattice structure.

17. A charge dissipating mat as defined in claim 16 wherein the protruding lattice structure includes an array of stress relief cavities.

* * * * *

UNITED STATES PATENT AND TRADEMARK OFFICE

CERTIFICATE OF CORRECTION

PATENT NO. : 4,491,894

DATED : January 1, 1985

INVENTOR(S) : Warren R. Pitts

It is certified that error appears in the above—identified patent and that said Letters Patent is hereby corrected as shown below:

Delete the temperature reading in Column 5, line 32, namely "22 °F" and revise to "72° F"

Signed and Sealed this

*Thirteenth* Day of *August 1985*

[SEAL]

*Attest:*

DONALD J. QUIGG

*Attesting Officer*

*Acting Commissioner of Patents and Trademarks*